US005141044A

United States Patent [19]

Hying et al.

[11] Patent Number: 5,141,044

[45] Date of Patent: Aug. 25, 1992

[54] BREAKAWAY ROLL-UP DOOR

[75] Inventors: Clement Hying, Germantown; Gregory S. Hahn, Milwaukee, both of Wis.

[73] Assignee: ASI Technologies, Inc., Milwaukee, Wis.

[21] Appl. No.: 646,532

[22] Filed: Jan. 25, 1991

[51] Int. Cl.[5] ..... E06B 9/17

[52] U.S. Cl. ..... 160/271; 160/291; 160/310; 160/265

[58] Field of Search ..... 160/271, 274, 265, 310, 160/319, 267.1, 270, 268.1, 291; 49/26, 27, 28

[56] References Cited

U.S. PATENT DOCUMENTS 5,025,847 6/1991 Mueller ..... 160/265 X
5,048,588 9/1991 Weishar et al. ..... 160/265
5,056,579 10/1991 Krafutler ..... 160/271

*Primary Examiner*—Blair M. Johnson

[57] ABSTRACT

A roll-up door in which the bottom bar is attached to the flexible door curtain has a transverse opening at an end adjacent to a jamb of the frame of the door. A breakaway shaft travels in a track in the jamb and has one end that normally seats in the transverse opening and provides a link between the bottom bar and the jamb. The other end of the shaft is restrained so that the shaft is held in a generally horizontal attitude. The opening in the bar and the breakaway shaft have cooperating means to normally retain the shaft in the opening but which are releasable upon a force striking the curtain or bottom bar. The breakaway shaft will separate from the bar upon impact thereby freeing the bar from engagement withthe jamb and preventing damage. The breakaway shaft may thereafter be reinserted into the opening in the bar to reconnect the bottom bar to the track and permit continued operation of the door. The invention further includes a provision for halting the operation of the door upon impact through the use of a switch actuator mounted in the opening in the bar and normally engageable by the breakaway shaft. The actuator is released when the shaft leaves the opening to thereby disable the drive for rolling and unrolling the curtain.

9 Claims, 3 Drawing Sheets

NORMAL

DISCONNECT SWITCH OPEN

DISCONNECT SWITCH RESTORED

MANUAL RESET

BREAKAWAY ROLL-UP DOOR

BACKGROUND OF THE INVENTION

This invention relates to roll-up doors, and particulary to a roll-up door having a mechanism that will release the bottom of the door from its mountings upon impact against the door and which is a readily returnable to an operating condition after impact.

Roll-up doors are widely used in industry to close off sections of factories or warehouses or to seal a doorway of such a facility that leads to the outside. The doors are typically formed with a flexible fabric curtain or a series of interconnected horizontal slats which together form a flexible curtain. The curtain is usually wound about a drum at its upper end, and a bottom bar extends across the lower free end of the curtain. The lateral sides of the bottom bar typically travel in tracks or channels provided in side jambs or columns forming the frame of the door opening. The curtain drum is powered to roll-up and to unwind the curtain. A counterforce mechanism using either a counter weight or tension springs exerts a force against the bottom bar to maintain the curtain taut.

The roll-up industrial doors are designed to operate very quickly and usually automatically upon the approach of a vehicle to either side of the closed door. However, it happens that the door may not be fully open before a vehicle enters the doorway with the result that the curtain or the bottom bar or both may be struck by the vehicle. This can result in severe damage to the curtain, to the bottom bar, or to the frame, effectively making the door unusable until damaged parts are replaced.

A need exists for a roll-up door that will react to an impact against the curtain or bottom bar by yielding to the force without damaging parts and which can be quickly returned to operating condition. Previous attempts to achieve a break away roll-up door have relied upon a friction fit of parts that may not release when the curtain or bottom bar are struck with a force that is not wholly normal to the plane of the curtain. Also, previous attempts have required extensive and time consuming efforts to prepare the door for reuse.

SUMMARY OF THE INVENTION

This invention provides a roll-up door in which the bottom bar that is attached to the flexible door curtain has at least one transverse opening at an end adjacent to a jamb of the frame of the door. A breakaway shaft travels in a track in the jamb and has one end that normally seats in the transverse opening and provides a link between the bottom bar and the jamb. The other end of the shaft is restrained so that the shaft is held in a generally horizontal attitude. The opening in the bar and the breakaway shaft have cooperating means to normally retain the shaft in the opening but which are releasable upon a force striking the curtain or bottom bar. The breakaway shaft will separate from the bar upon impact thereby freeing the bar from engagement with the jamb and preventing damage. The breakaway shaft may thereafter be reinserted into the opening in the bar to reconnect the bottom bar to the track and permit continued operation of the door.

The invention further includes a provision for halting the operation of the door upon impact through the use of a switch actuator mounted in the opening in the bar and normally engageable by the breakaway shaft. The actuator is released when the shaft leaves the opening to thereby disable the drive for rolling and unrolling the curtain.

In a preferred embodiment of the invention, a transverse opening and breakaway shaft are provided on both ends of the bottom bar. The breakaway shafts mount sleeves that ride in the tracks in the jambs. The breakaway shafts mount adjustable ball detents that are received in detent recesses provided in the openings. The opposite ends of the breakaway shafts are connected to a counterforce mechanism that urges the shaft, and thereby the bottom bar, downwardly. The opposite ends of the breakaway shafts are also each connected to a strap that is wound with the curtain drum to urge the opposite ends of the breakaway shafts upwardly against the counterforce.

It is a principal object of the invention to provide a roll-up door that will release from its track upon being struck by a force having a component normal to the plane of the door without damage to parts of the door.

It is another object of the invention to provide such a roll-up door that is quickly returnable to an operating condition following a release.

It is a further object of the invention to provide such a roll-up door in which the driving of the door is automatically halted when it releases upon impact and cannot be restarted until the released parts are properly reassembled.

The foregoing and other objects and advantages of the invention will appear from the detailed description that follows. In the description, reference is made to the accompanying drawings which illustrate a preferred embodiment of the invention.

DETAILED DESCRIPTION OF THE PREFERRED EMBODIMENT

Figure 2:
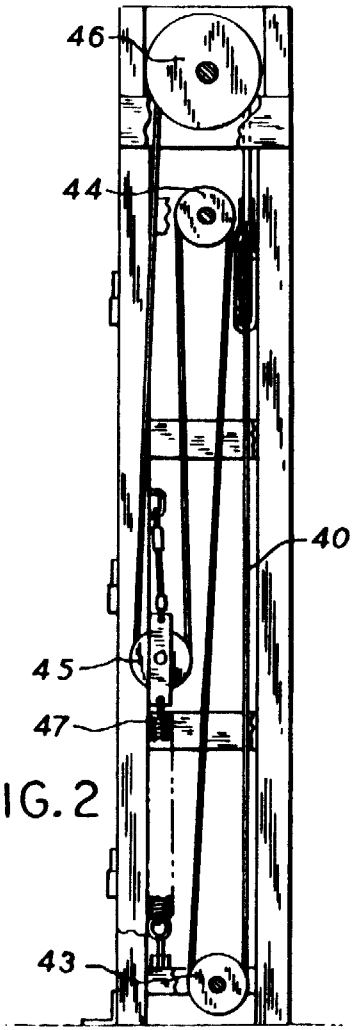
FIG. 2 is a side view of the door of FIG. 1.
Figure 1:
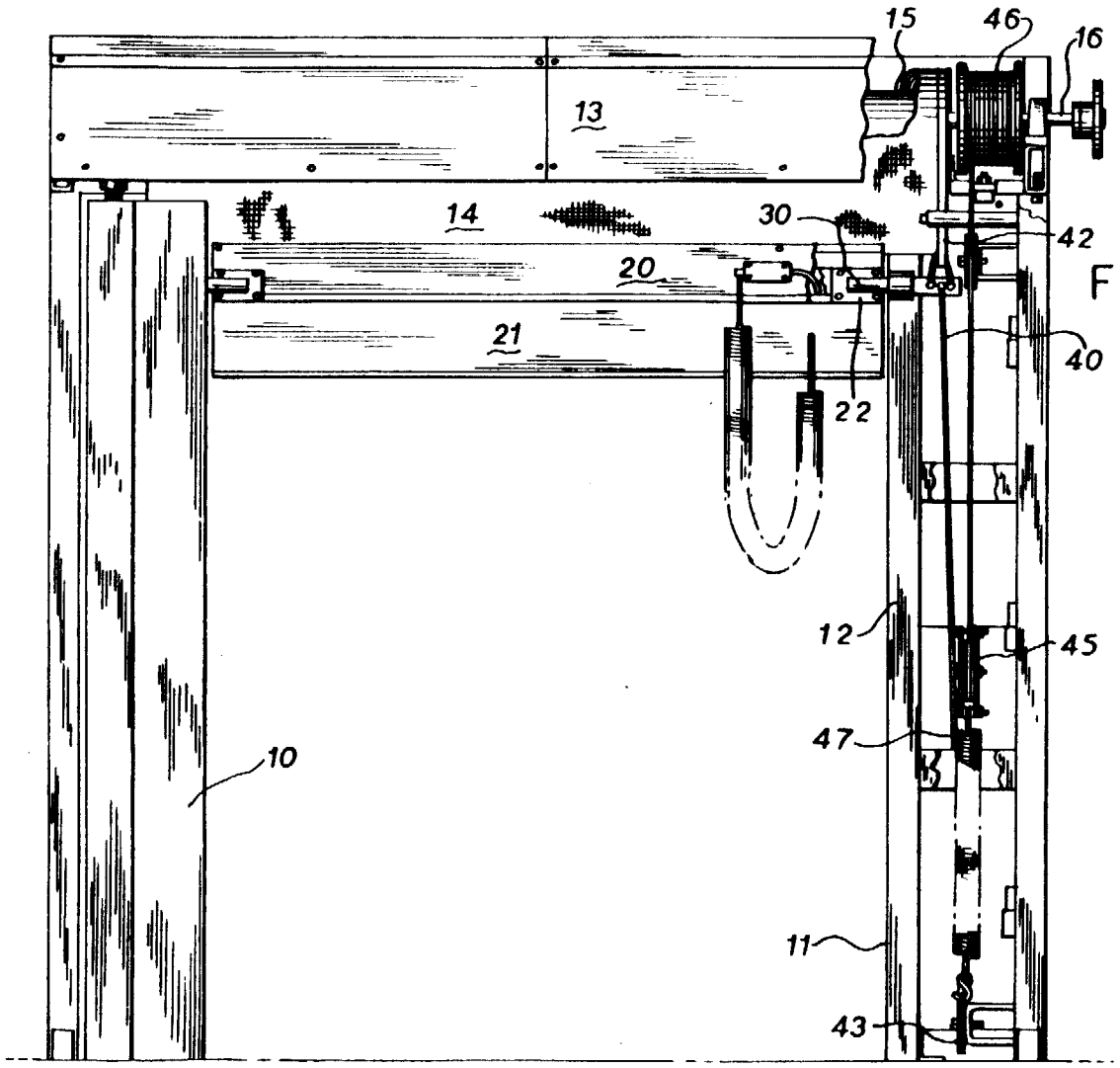
FIG. 1 is a front view in elevation, and partially in section, of a roll-up door in accordance with the invention.

The roll-up door includes a frame formed of side channel assemblies or jambs 10 and 11 each of which includes a vertical track 12 defined by spaced elements. The frame is completed by a horizontal header 13 that spans the jambs 10 and 11. A flexible fabric curtain 14 is wound about a drum 15 mounted on a powered shaft 16. The shaft 16 may be driven by a drive such as that illustrated in U.S. Pat. No. 4,941,320 issued Jul. 17, 1990 for "Industrial Hydraulic Door Operator" and assigned to the assignee of this application. The lateral side edges of the fabric curtain 14 are loosely received in the tracks 12 in the jambs 10 and 11.

A metal bottom bar 20 is mounted to the lower free end of the curtain 14. The bottom bar 20 includes an elastomer safety edge 21 along its bottom that responds to the compression of pockets in edge 21 if the curtain 14 encounters an obstruction as it is attempted to be lowered, in a known manner. The bottom bar 20 is provided with transverse openings at each ends. The openings are defined in a pair of receptacle blocks 22 each of which defines a U-shaped opening 23 that extends through the plane of the curtain 14 and which opens outwardly towards a respective jamb. Each receptacle block 22 mounts a pair of laterally spaced detent recess members 24 and 25 in the top and bottom of the opening 23, respectively.

Breakaway shafts 30 mount nylon friction sleeves 31 intermediate to the shaft ends and the friction sleeves 31 travel in the tracks 12. One end 32 of each breakaway shaft 30 is adapted to be received in a corresponding opening 23 in the end of the bottom bar 20. This end 32 of the shaft 30 mounts a pair of ball detents 33 and 34 that are adapted to be received in the detent recess members 24 and 25, respectively, of a receptacle block 22. When the breakaway shaft 30 is positioned with its first end 32 within the opening 23 in the receptacle block 22, an actuator 35 of a disconnect switch 36 is engaged by the breakaway shaft 30.

Figure 3:
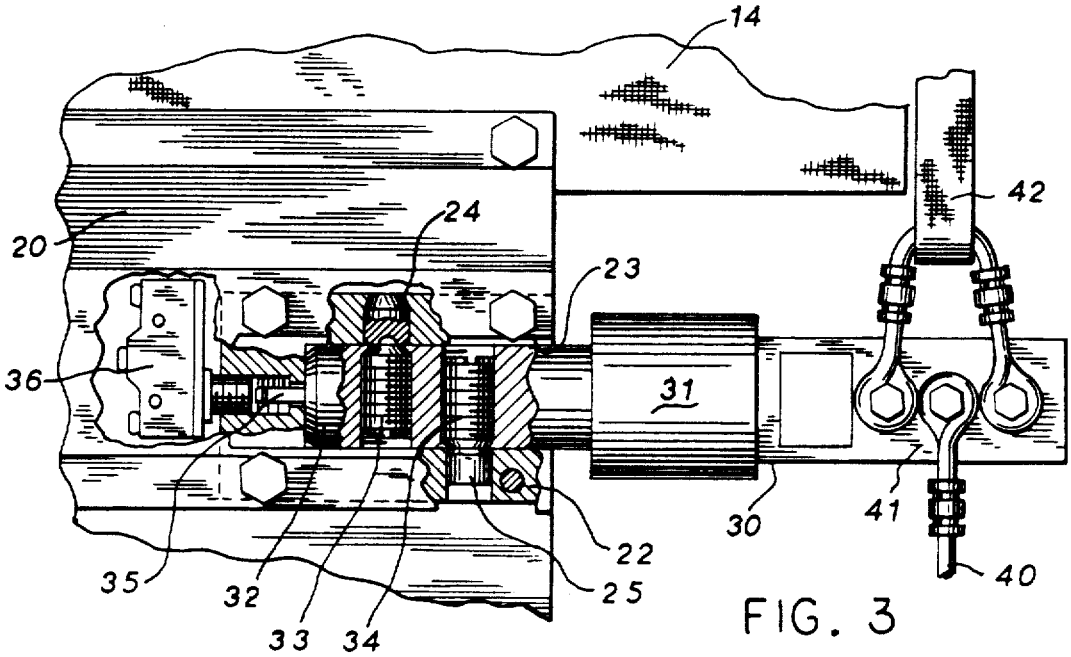
FIG. 3 is an enlarged view in elevation of the breakaway mechanism of the present invention.
Figure 4:
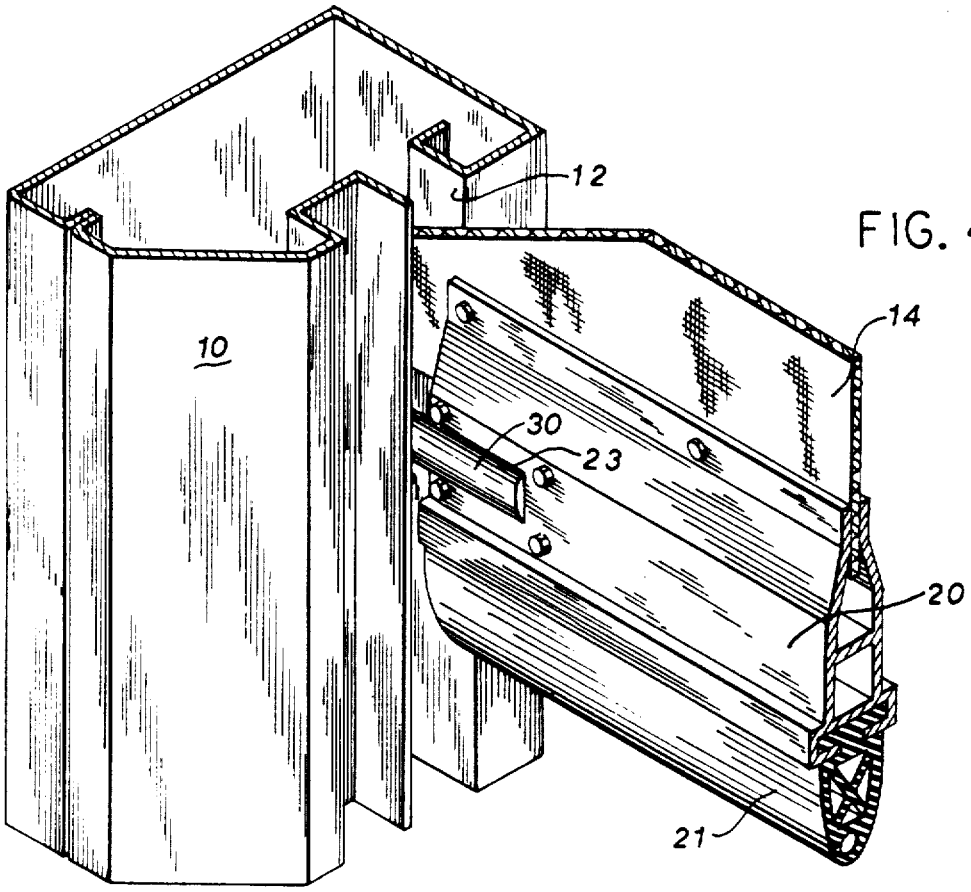
FIG. 4 is a view in perspective of the breakaway mechanism in relation to one of the jambs of the door frame.

As shown in FIG. 3, the detent recess members 24 and 25 are fitted into openings in opposite sides of the receptacle block 22. The recess members each include a hemispherical recess that is adapted to receive the ball of a respective ball detent 33 and 34. In a known manner, the balls of the ball detents are mounted in and captured by a detent body that is externally threaded and received in a threaded cross-bore in the one end 32 of the shaft 30. The balls are biased outwardly of the body by internal springs. By changing the position of the body within the threaded cross-bores, the extent that the balls enter the detent recesses can be adjusted and the force required to dislodge a ball from a ball recess can thereby be adjusted.

When the breakaway shafts 30 are in place in the openings 23 in the bottom bar 20, the shafts 30 connect the bottom bar to the jambs 10 and 11 so that the curtain 14 will travel in the proper plane while the curtain moves up and down as the door is opened and closed. However, should the curtain 14 or bottom bar 20 be struck by a vehicle or any other source of significant force, the breakaway shafts 30 will unseat from the openings 23 in the bottom bar 20 and the bottom bar 20 will be released from its connection with the jambs 10 and 11 so that the curtain 14 and bottom bar 20 can absorb the force without damage to any of the parts of the door. When a collision occurs, one or both of the disconnect switches 36 will also be opened by reason of the actuators 35 no longer being engaged by the breakaway shafts 30. This will cut power to the circuit for the drive motor thereby stopping the curtain in the position in which it is when the collision occurs.

To return the door to an operating condition involves the simple task of reengaging the breakaway shafts 30 with the respective openings 23 in the bottom bar 20 and tucking the edges of the curtain 14 into the tracks 12 in the jambs 10 and 11. A reset switch 38 may also be provided which is required to be manually activated after the disconnect switches 36 have again been closed by engagement of their actuators 35 with the breakaway shafts 30. The reset switch 38 will re-energize the circuit to the drive motor to allow the door to continue in its normal operation.

A schematic diagram of a cutout circuit for disabling door motion in response to opening of either of the disconnect switches 36 is shown in FIGS. 5*a*–5*d*. The circuit is connected to a control voltage source 40 suitable for operation of a cutout relay 41. A first set of contacts 41*a* on the cutout relay 41 are provided for enabling a conventional motor control circuit (not shown). For example, a three phase, reversing motor control circuit as shown in U.S. Pat. No. 4,941,320 may be modified as would be apparent to those skilled in the art to be enabled by the contacts 41*a*.

Figure 5A:
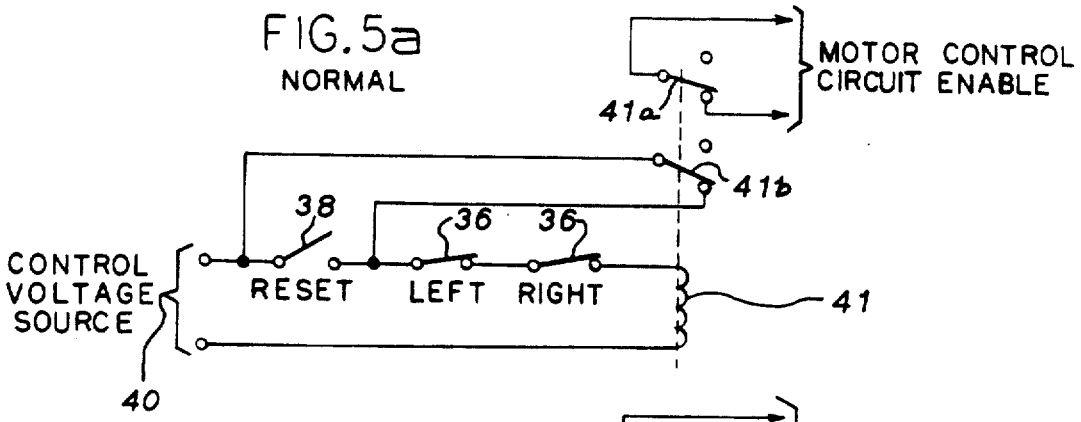
FIGS. 5 a-d are partial circuit diagrams of the control of the motor drive of the door illustrating different states of operation.

In FIG. 5*a*, the cutout circuit is shown in a normal configuration, with the cutout relay 41 electrically held in by current flowing form the control voltage source 40 through a series connection of a second set of contacts 41*b* on the cutout relay 41 and both normally closed door disconnect switches 36. As long as the door disconnect switches 36 both remain closed (i.e. with their respective mechanisms not broken away), the motor control circuit remains enabled, and the door operates normally.

Figure 5B:
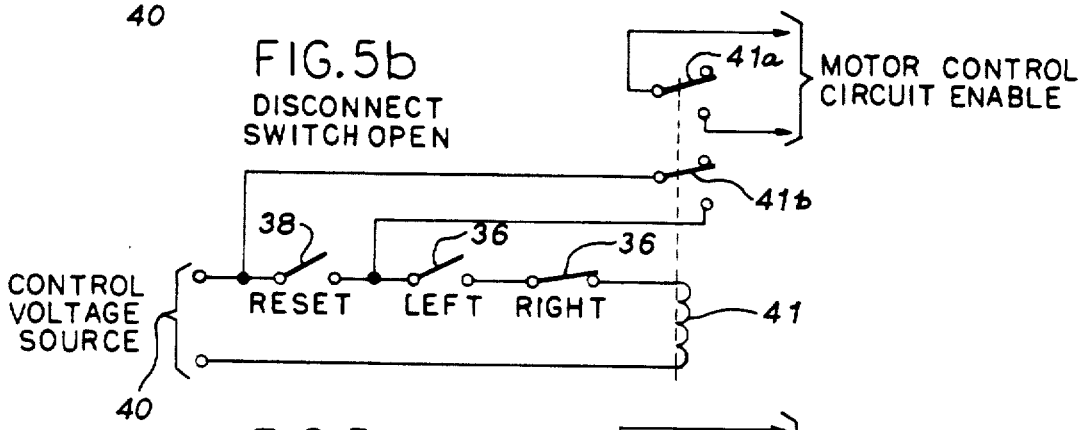

As shown in FIG. 5*b*, if either of the disconnect switches 36 are opened, due to breakaway of the respective mechanism, current to the cutout relay 41 is interrupted, and the cutout relay 41 drops out. Dropping out of the cutout relay 41 causes contacts 41*a* to open, disabling the motor control circuit. Contacts 41*b* on the cutout relay 41 are also opened by the dropping out of the cutout relay. As a result, once the cutout relay is dropped out, reclosing of the disconnect switches 36 will not effect pulling in of the cutout relay 41. Instead, the reset switch 38 must be manually depressed following a breakaway event, to pull in the cutout relay 41 and restore normal circuit operation.

Figure 5C:
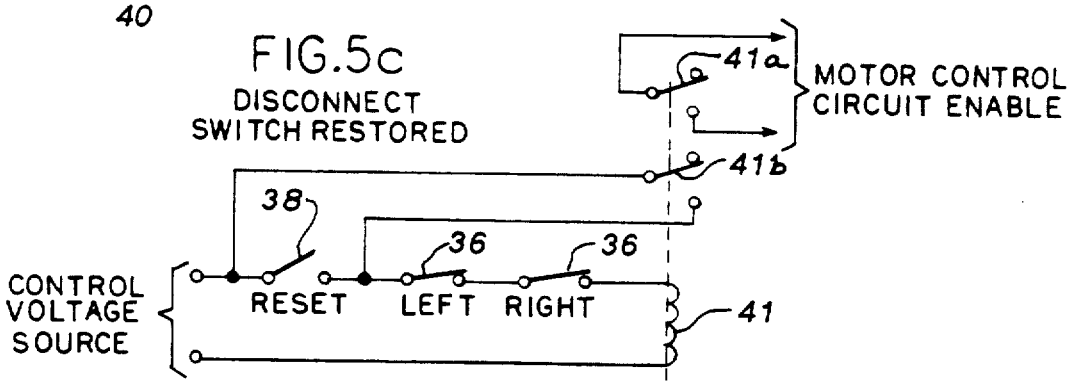
Figure 5D:
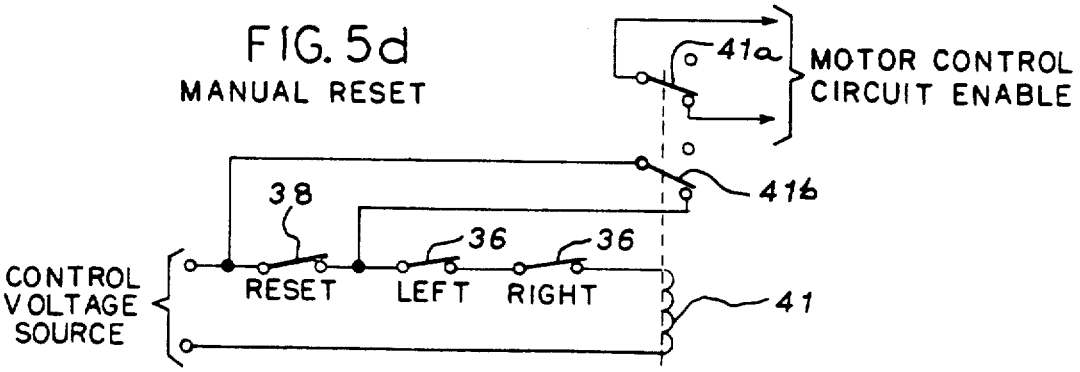

As specifically illustrated in FIG. 5*c*, both disconnect switches 36 have been restored to the normal, closed position following a breakaway event, but the cutout relay 41 remains dropped out due to the open circuit across contacts 41*b*. However, when the reset switch 38 is manually activated as shown in FIG. 5*d*, current flows directly through the reset switch 38 and the disconnect switches 36 to pull in the cutout relay 41. Once the cutout relay 41 is pulled in, the reset switch 38 may be released, and the cutout relay remains electrically held in by current through contacts 41*b* and the disconnect switches 36 (i.e. back to the configuration of FIG. 5*a*.)

It should be noted that a power interruption to the cutout circuit will have the same effect as opening one of the disconnect switches 36. Manual depression of the reset switch 38 is therefore required after a power interruption. Also, depression of the reset switch 38 prior to restoring the disconnect switches 36 to the normally closed position will have no effect on pulling in the cutout relay 41 or energizing the motor control circuit. If either of the disconnect switches 36 remain open, cutout relay 41 remains dropped out and the motor control circuit remains disabled.

Minimal effort is required to reposition the breakaway shafts 30 within the openings in the bottom bar because the breakaway shafts are held in a proper horizontal position within the tracks 12, both horizontally and vertically, even after they are released from the bottom bar 20. This proper positioning is accomplished by a cable or strap 40 attached to an opposite end 41 of each breakaway shaft 30 and urging the shaft downwardly, and a retaining strap 42 also connected to the opposite end 41 of the shaft 30 and wound about the drum 15 at a lateral edge of the curtain 14 and urging the shaft upwardly. The cable 40 is connected about a lower pulley 43, an upper pulley 44, a spring pulley 45, and about a cable drum 46 which rotates with the curtain drum 15. The spring pulley 45 is attached to the free end of a tension spring 47. The cable 40 and spring 47 provide a counter weight force which tends to pull the shaft 30 downwardly. When the shafts 30 are connected to the bottom bar 20, the cable 40 and spring 47 will maintain the curtain 14 taut. The combination of the forces exerted by the strap 42 and cable 40 will hold each breakaway shaft 30 in a generally horizontal position in the track 12 even when it is disconnected from the bottom bar 20, and will also hold the shaft in the vertical position that it occupied when released from the bottom bar.

The force exerted by the ball detents 33 and 34 is adjustable by adjusting the position of the set screwes behind the detents. Thus, the force necessary to cause release of the breakaway shafts 30 is adjustable.

The release of the bottom bar 20 from the breakaway shafts 30 is not dependent upon the direction from which a force strikes the curtain or bottom bar, so long as that force is not wholly vertical. Any sufficient force having a component that is normal to the plane of the curtain 14 or bottom bar 20 will release the breakaway shafts 30 because the shafts are each held in an opening 23 at only two spaced points of contact.

Although the invention is shown in relation to a door including a fabric curtain 14 of continuous construction, it can also be applied to other forms of roll-up doors such as those formed of interlocking or joined horizontal slats. Also, the ball detents and detent recesses may be reversed between the breakaway shaft 30 and bottom bar opening 23 such that the detents would be mounted in the receptacle block 22 and the detent recesses would be mounted in the shaft 30. Furthermore, more than two sets of detents and detent recesses may be provided in each opening 23 and shaft 30.

The present invention provides a high speed roll-up door that can survive a collision without sustaining any damage that is detrimental to door operation. The time to reset the door and have it back in operation is at a minimum thereby providing the user with guaranteed operation even under severe circumstances. Production flow is maintained by not having to wait for repairs.

We claim:

1. A roll-up door, comprising:

a frame having spaced jambs joined at the top by a header, the jambs each defining elongated tracks;

a powered drum mounted in the header;

a flexible curtain wound about the drum and having its lateral edges disposed in the tracks;

a bottom bar attached to the free end of the curtain and extending between the jambs, said bar having a transverse opening at one end;

a breakaway shaft riding in the track of a respective jamb, said shaft having one end received in the opening in the bar to normally hold the bar to the track;

said bar and shaft having a cooperating detent and detent recess that normally holds the shaft in the bar but which releases upon the curtain or bar being struck by a force having a component normal to the surface of the curtain; and a drive for the drum and including a disconnect switch having an actuator engaged by the breakaway shaft when the shaft is in place in the bar to thereby enable the drive.

2. A roll-up door in accordance with claim 1 wherein the opposite end of the bar also includes a transverse opening and a second breakaway shaft rides in the track in the opposite jamb and has one end received in the opening in the opposite end of the bar, the transverse opening in the opposite end of the bar and the second breakaway shaft having a cooperating detent and detent recess that normally holds the second breakaway shaft in the bar but which will release upon the curtain or bar being struck by a force having a component normal to the surface of the curtain.

3. A roll-up door in accordance with claim 1 together with a counter-force mechanism that includes a cable that is attached to the opposite end of the shaft to urge the breakaway shaft and the bottom bar downwardly, and a flexible strap attached to said opposite end of the shaft and wound about the drum to urge the breakaway shaft upwardly.

4. A roll-up door, comprising:

a frame having spaced jambs joined at the top by a header, the jambs each defining elongated tracks;

a drum disposed in the header;

a flexible curtain wound about the drum at one end;

a drive for the drum to roll and unroll the curtain;

a bottom bar attached to the free end of the curtain and extending between the jambs, said bar having transverse openings at each end which extend through the plane of the curtain and open towards the respective jamb;

a pair of breakaway shafts each disposed to ride in a respective track and including one end received in the respective opening in the bar to normally hold the bar in the tracks;

means for releasably holding the ends of the shafts in the openings in the bar, said means releasing the shafts from the bar when the curtain is struck by a force having a component normal to its surface; and means attached to the opposite ends of each shaft for maintaining the shafts in a generally horizontal attitude and vertical location even when the shafts are released from the bar.

5. A roll-up door in accordance with claim 4 together with a disconnect switch with an actuator disposed in each opening in the bar and engageable by a respective breakaway shaft when the breakaway shaft is held in place in the bar, the disconnect switches opening the circuit to the drive when a breakaway shaft is disengaged from the bar.

6. A roll-up door in accordance with claim 4 wherein the means attached to the opposite end of each shaft includes a counterforce mechanism having cables attached to the opposite end of each breakaway shaft to urge the breakaway shafts and the bottom bar downwardly, and a flexible strap attached to the opposite end of each shaft and wound about the drum to urge the shaft upwardly.

7. A roll-up door, comprising:

a frame having spaced jambs joined at the top by a header, the jambs each including elongated tracks;

a drum mounted in the header;

a flexible curtain wound about the drum and having its lateral edges disposed in the tracks;

a bottom bar attached to the free end of the curtain and extending between the jambs, said bar having a transverse opening at one end;

a breakaway shaft including a sleeve received in the track of a respective jamb, said shaft having one end received in the opening in the bar to normally hold the bar in the track;

means for releasably holding the end of the shaft in the opening in the bar, said means releasing upon the curtain or bar struck by a force having a component normal to the surface of the curtain; and a drive for the drum including a control circuit having a disconnect switch and a reset switch;

said disconnect switch having an actuator engaged by the breakaway shaft when the shaft is in place in the bar to complete the energizing circuit, said disconnect switch opening the circuit when the shaft releases from the bar and until after the shaft is replaced in the bar and the reset switch has been actuated.

8. A roll-up door, comprising:

a frame having spaced jambs joined at the top by a header, the jambs each including elongated tracks;

a drum disposed in the header;

a curtain wound about the shaft at one end and having its lateral edges disposed in the tracks;

a bottom bar attached to the free end of the curtain and extending between the jambs, said bar having transverse openings at each end which extend through the plane of the curtain and open towards the respective jamb, each opening including upper and lower detent recesses spaced from each other along the length of the bar;

a pair of breakaway shafts each including a sleeve that rides in a respective track, said shafts each having one end that includes a pair of spring loaded detents adapted to releasable engage with the detent recesses of a respective bar opening to thereby join the bottom bar to the tracks;

a counter-force mechanism including a cable attached to the opposite end of each shaft to urge the shaft downwardly; and a strap attached to the opposite end of each shaft and wound about the drum to urge the shaft upwardly, said cable and strap holding each shaft substantially horizontal when the shaft is disconnected from the bar.

9. A roll-up door in accordance with claim 8 together with a drive for the drum and means for sensing when either one of the shafts is disconnected from the bar to thereby disable the drive.

* * * * *